United States Patent [19]

Abe et al.

[11] 4,272,182

[45] Jun. 9, 1981

[54] APPARATUS FOR CONTROLLING THE DENSITY OF A REPRODUCED IMAGE IN AN ELECTROPHOTOGRAPHIC COPYING MACHINE

[75] Inventors: Shunichi Abe; Mistuo Akiyama; Fumio Iwai; Hiroshi Kuru, all of Hachioji, Japan

[73] Assignee: Konishiroku Photo Industry Co., Ltd., Tokyo, Japan

[21] Appl. No.: 1,060

[22] Filed: Jan. 5, 1979

[30] Foreign Application Priority Data

Jan. 17, 1978 [JP] Japan ..... 53-2756

[51] Int. Cl.[3] ..... G03G 15/00

[52] U.S. Cl. ..... 355/14 D; 118/665; 118/679; 250/206; 355/3 DD

[58] Field of Search ..... 355/14 D, 3 DD, 10; 118/624, 647–651, 665, 679, 708; 250/206

[56] References Cited

U.S. PATENT DOCUMENTS

| | | | |
|---|---|---|---|
| 3,872,825 | 3/1975 | Davidson | 355/3 DD |
| 3,873,197 | 3/1975 | Whited | 355/3 DD |
| 4,050,806 | 9/1977 | Miyakawa et al. | 355/14 D |

*Primary Examiner*—R. L. Moses

*Attorney, Agent, or Firm*—Bierman & Bierman

[57] ABSTRACT

Apparatus for controlling the density of a reproduced image of an original to be copied in an electrophotographic copying machine by maintaining a fixed, predetermined image-developing bias voltage during development of a reference patch image and controlling the bias voltage in response to settings of image density selectors during the development of the original image.

5 Claims, 1 Drawing Figure

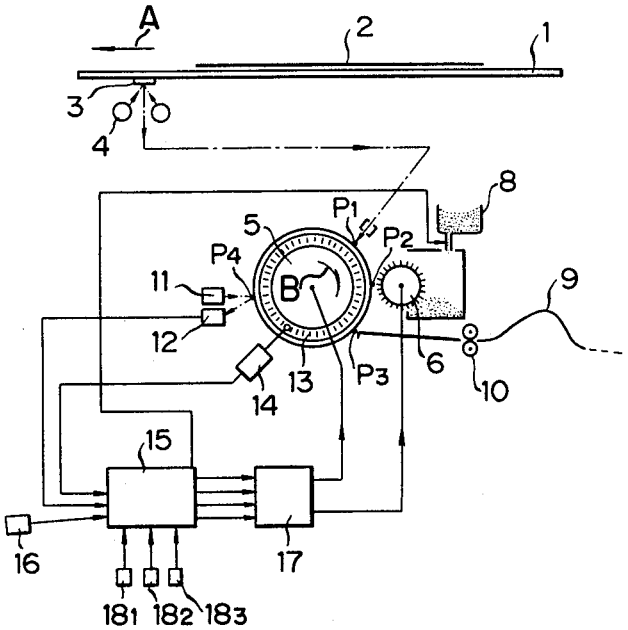
A
2
1
3
4
8
P1
5
P2
P4
11
B
9
12
6
13
P3
10
14
15
16
17
181
182
183

APPARATUS FOR CONTROLLING THE DENSITY OF A REPRODUCED IMAGE IN AN ELECTROPHOTOGRAPHIC COPYING MACHINE

The present invention relates to an apparatus for controlling the density of a reproduced image in an electrophotographic copying machine.

As one of the methods for controlling the concentration of a reproduced image of an original to be copied, it has been hitherto known to control a bias voltage applied between a photo-sensitive drum, on which an electrostatic latent image of the original to be copied is produced, and a developing electrode (e.g. a magnetic brush) in dependence on preset concentration values desired for the reproduced image thereby to vary controllably the quantity of the toner adhered to the surface of the photo-sensitive drum while maintaining constantly the quantity of irradiation light reflected from the original to which the photo-sensitive drum is exposed. In this connection, it will be understood that the toner concentration of the developing material supplied to the developing electrode should be maintained as constant in order to control the density of the reproduced image as a function of the bias voltage.

For the control of the toner concentration, it has been hitherto also known to provide a patch (standard mark) of a predetermined uniform density on an original carrier plate at a leading or trailing location outside of the region in which the original to be copied is placed, whereby the electrostatic image of the patch is produced and developed for every copying operation of the original. The toner image of the patch thus produced on the photo-sensitive drum is irradiated with a light beam of a predetermined intensity, and the quantity of reflected light is detected by a photo-sensor, the output signal of which is utilized for controlling the toner supply to the developing electrode thereby to maintain the toner concentration at the developing electrode.

An object of the invention is to provide an apparatus for controlling the density of the reproduced image of an original in an electrophotographic copying apparatus of the above mentioned type which is capable of controlling the bias voltage in an improved manner.

In the following, description will be made on a preferred embodiment of the invention by referring to the accompanying drawing. The accompanying drawing shows a schematic arrangement of a control apparatus for controlling the density of a reproduced image in an electrophotographic copying apparatus according to an exemplary embodiment of the invention.

Reference numeral 1 denotes an original carrier plate or copy board on which an original 2 to be reproduced or copied is disposed. The original carrier plate 1 is adapted to be moved in the direction indicated by an arrow A to be scanned by an irradiation lamps 4 upon copying operation. A patch 3 having a predetermined uniform density is provided on a lower surface of the carrier plate 1 in front of the leading edge of the original 2 with an appropriate distance therefrom. The reflected light image of the patch 3 as produced through irradiation by the light source lamps 4 is projected to a photo-sensitive layer of a drum 5 by way of an optical system. The drum 5 is rotated in the direction indicated by an arrow B in synchronism with the movement of the original carrier 1 upon copying operation an electrostatic image of the patch 3 and subsequently of the original 2 are produced in the circumferential layer of the drum 5 at the location denoted by reference symbol P1. These electrostatic latent images are developed in a form of toner images at the location P2 through contact with a magnetic brush roller 6 adhered with a mixture of iron powder and toner particles. The magnetic brush roller 6 is supplied with a controlled quantity of a toner material from a toner supply apparatus 8.

On the other hand, a recording sheet 9 is supplied from a sheet supply source, not shown, through a transporting roller apparatus 10, the driving of which is so controlled in conjunction with the driving of the drum 5 that the recording sheet as being fed is superposed on the toner image of the original 2 produced on the circumferential surface of the drum 5 at a location P3. Thereafter, transfer of the toner image to the recording sheet 9 and the fixation thereof are carried out in the manner known in the art.

The toner image of the patch 3 is irradiated by light of a predetermined intensity produced by a light emitting element 11 at a location P4 and the quantity of reflected light is detected by a photo-sensor 12, the output signal of which is processed by a control circuit 15 described hereinafter and supplied to the toner supply apparatus 8 as the control signal for controlling the supply quantity of toner.

Mounted rotatably together with the drum 5 is a disc 13 which has a plurality of holes formed in the peripheral portion thereof with an equal angular distance between the holes. An angle sensor 14 constituted by a photo-sensor is so positioned that a light beam (not shown) passing through the holes impinges on the angle sensor 14. Thus, the output signal from the angle sensor 14 is a pulse signal of a pulse repetition frequency proportional to the rotation angle of the disc 13 and hence that of the drum 5.

The control circuit 15 which may be constituted by a micro-computer or the like is adapted to be enabled by a copying operation initiating command switch 16 to perform a sequence control for the copying operation such as the controlling of driving the original carrier plate 1, drum 5, magnetic brush roller 6 and sheet feeding or transporting roller 10 and additionally control the output voltage of a bias voltage generator circuit 17 of a programmable circuit configuration. The various controlling operations excuted by the control circuit 15 are effected on the basis of the timing signal derived from the pulse signal output from the angle sensor 14.

For the bias voltage control by the control circuit 15, the bias voltages are changed over among various levels such as 180 V, 280 V and 380 V in dependence on the changing over of switches $18_1$, $18_2$ and $18_3$ for setting different density values of the image to be reproduced. In this manner, the bias voltage applied between the drum 5 and the magnetic brush roller 6 is varied to vary the quantity of toner adhered to the roller 6. Such bias voltage control is effected only during the period in which the electrostatic latent image is located at the position adjacent to the magnetic brush roller 6. For the development of the latent image of the patch 3, a bias voltage of a predetermined amplitude (e.g. 280 V) is used independently from the set values at the switches $18_1$, $18_2$ and $18_3$. More specifically, the control circuit 15 determines the period during which the electrostatic latent image of the patch 3 is at location P2 on the basis of the counted pulse number available from the pulse signal output from the angle sensor 14, whereby the bias voltage applied between the drum 5 and the magnetic brush roller 6 during this peiod is controlled to the predetermined magnitude independently from the density values set at the switches 18 which are thus used selectively for the bias voltage control only for the development of the latent image of the original 2.

In this manner, while the density of the image of original 2 is controlled in dependence on the concentration value as selected by the switches 18, the image density of the patch 3 is always produced at a predetermined constant bias voltage and thus represents proportionally the prevailing concentration of toner actually used in the development. The density of the patch image is detected by the sensor 12 and utilized for controlling the toner supply apparatus 8 to maintain constantly the toner concentration. When the toner concentration is controlled to a predetermined constant value in this manner, then the control of the density of the original image through the control of the bias voltage can be effected in a satisfactory manner.

In the foregoing description, it has been assumed that the signal for controlling the toner supply is produced by detecting the density of the toner image of a patch provided on the original carrier plate. However, the invention is not restricted to such arrangement. For example, a patch of an electrically insulative film may be provided on the circumferential surface of the drum 5 at a location outside of the region in which the electrostatic latent image of the original is to be produced and used for the same purpose described above. Alternatively, the patch may be provided at a location other than the original carrier plate and the drum for the same effects.

What is claimed is:

1. In an apparatus for controlling the density of a reproduced image of an original to be copied in an electrophotographic copying machine comprising a copy board; an electrophotosensitive medium; an optical system positioned between the copy board and the electrophotosensitive medium for forming an electrostatic image of the original on the medium; a developing device for changing the electrostatic image to a visible toner image; first means for controlling a toner concentration, the first means comprising a patch of predetermined uniform demsity disposed at a location remote from the original to be copied and adapted for forming, in conjunction with the optical system and developing device, a toner image of the patch on the electrophotosensitive medium, and a detector for measuring the density of the patch toner image and for generating an output signal for controlling a toner concentration; and second means for controlling a bias between the developing device and the electrophotosensitive medium for controlling the density of the reproduced image, the improvement comprising:

third means for fixing the bias at a predetermined value at least during development of the patch toner image and for fixing the bias at a selectable value at least during development of the original image.

2. In an apparatus according to claim 1, the detector comprising a light emitter element for projecting a beam onto the patch toner image and a photosensor to measure the intensity of the beam reflected from the patch toner image.

3. In an apparatus according to claim 1, the photosensitive medium being drum shaped.

4. In an apparatus according to claim 1, the original carrier plate being movable.

5. An apparatus for controlling the density of a reproduced image of an original to be copied in an electrophotographic copying machine of a type in which a bias voltage is applied between a photosensitive medium, on which an electrostatic latent image of the original is produced, and a developing electrode, and in which a reference latent image is produced on the photosensitive medium at a location externally of the region of the medium in which the electrostatic latent image of the original is produced, the density of the developed image of the reference latent image being detected for controlling the concentration of a toner developing composition, said density controlling apparatus comprising:

means for maintaining the bias voltage during development of the reference latent image at a predetermined constant value and independently of present density values selected for the reproduced image of the original, and said means further controlling the bias voltage on the basis of said preset density values during development of the electrostatic latent image of the original.

* * * * *